US007418934B2

(12) United States Patent
Ido et al.

(10) Patent No.: US 7,418,934 B2
(45) Date of Patent: Sep. 2, 2008

(54) VALVE TIMING CONTROLLER

(75) Inventors: Shinsuke Ido, Kariya (JP); Eiji Isobe, Kariya (JP)

(73) Assignee: Denso Corporation (JP)

( * ) Notice: Subject to any disclaimer, the term of this patent is extended or adjusted under 35 U.S.C. 154(b) by 18 days.

(21) Appl. No.: 11/712,587

(22) Filed: Mar. 1, 2007

(65) Prior Publication Data

US 2007/0204823 A1 Sep. 6, 2007

(30) Foreign Application Priority Data

Mar. 1, 2006 (JP) ..... 2006-055062

(51) Int. Cl.
*F01L 1/14* (2006.01)

(52) U.S. Cl. ..... 123/90.17; 123/90.15; 464/160

(58) Field of Classification Search ..... 123/90.15, 123/90.16, 90.17, 90.18, 90.2, 90.27, 90.31; 464/1, 2, 160

See application file for complete search history.

(56) References Cited

U.S. PATENT DOCUMENTS 6,883,482 B2 4/2005 Takenaka et al.
7,100,556 B2 9/2006 Sugiura
7,311,071 B2 * 12/2007 Yamanaka ..... 123/90.17

* cited by examiner

*Primary Examiner*—Ching Chang
(74) *Attorney, Agent, or Firm*—Nixon & Vanderhye PC

(57) ABSTRACT

A valve timing controller is provided with a first rotary element that rotates in response to a crankshaft, a second rotary element that rotates in response to a camshaft. Multiple link mechanisms are arranged adjacently in the rotational direction of the first rotary element to change a relative rotation phase between the first and second rotary elements. The link mechanism in each group is constituted by combining the first link linked to the first rotary element by a revolute pair with the second link linked to the second rotary element and the first link. The second link of the link mechanism in each group retains the first link of each of the link mechanisms in the same group and the other group in the rotational axis direction of the first rotary element between the second link and the first rotary element.

5 Claims, 7 Drawing Sheets

VALVE TIMING CONTROLLER

CROSS-REFERENCE TO RELATED APPLICATION

This application is based on Japanese Patent Application No. 2006-55062 filed on Mar. 1, 2006, the disclosure of which is incorporated herein by reference.

FIELD OF THE INVENTION

The present invention relates to a valve timing controller for an internal combustion engine that adjusts opening/closing timing of at least one of an intake valve and an exhaust valve opened/closed by a camshaft with torque transmission from a crankshaft.

BACKGROUND OF THE INVENTION

A valve timing controller includes a first rotary element to rotate in response to the movement of one of a crankshaft and a camshaft and a second rotary element to rotate in response to the movement of the other of the crankshaft and the camshaft. The controller changes a relative rotation phase between the rotary elements by a link mechanism to adjust valve timing.

JP-2005-48707A (U.S. Pat. No. 6,883,482 B2) discloses a device provided with two groups of link mechanisms that are constituted by combining a first link linked to a first rotary element by a revolute pair and a second link linked to a second rotary element and the first link by a revolute pair. Here, the link mechanisms in the respective groups are arranged in the rotational direction of the first and second rotational elements, thereby controlling off-balance in rotation due to inclination of these rotational elements with respect to the rotational axis.

When the first link of the link mechanism in each group is retained between the second link and the first rotary element in the same group, an area of a portion retained in the first link becomes possibly smaller depending on an arrangement state of the links. In this case, a portion which is not retained by the first link is more likely to be shifted in the rotational axis direction of the first and second rotary elements, causing a possible inclination of the first link to the rotational axis of the rotary elements. Such inclination of the first link is undesirable because it becomes the cause of interrupting an operation of the link mechanism, resultantly a valve timing adjustment.

SUMMARY OF THE INVENTION

The present invention is made from the foregoing problem, and an object of the invention is to provide a valve timing controller which achieves a smooth valve timing adjustment.

According to an aspect of the present invention, plural groups of link mechanisms are arranged adjacently in the rotational direction of the first rotary element. Each link mechanism is constituted by combining a first link linked to a first rotary element by a revolute pair with a second link linked to a second rotary element and the first link by a revolute pair. Therefore, the first and second rotary elements having a common rotational axis (hereinafter referred to simply as "rotational axis") are restricted to be inclined with respect to the rotational axis.

In addition, the second link of the link mechanism in each group retains the first link of each of the link mechanisms in the same group and the other group between the second link and the first rotary element. As a result, in the link mechanism in each group, the first link is retained not only between the second link in the same group and the first rotary element but also between the second link in the other group and the first rotary element.

Therefore, an area of a portion retained in the first link can be secured largely. Accordingly, in the link mechanism in each group, a portion that is not retained in the first link is difficult to be shifted in the rotational axis direction of the first rotational element, resultantly restricting an inclination of the first link to the rotational axis. Thus, in addition of controlling the first and second rotational elements, an inclination of the first link is restricted and a smooth valve timing adjustment can be achieved.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION OF EMBODIMENT

A first embodiment of the present invention will be hereinafter described with reference to the drawings.

Figure 2:
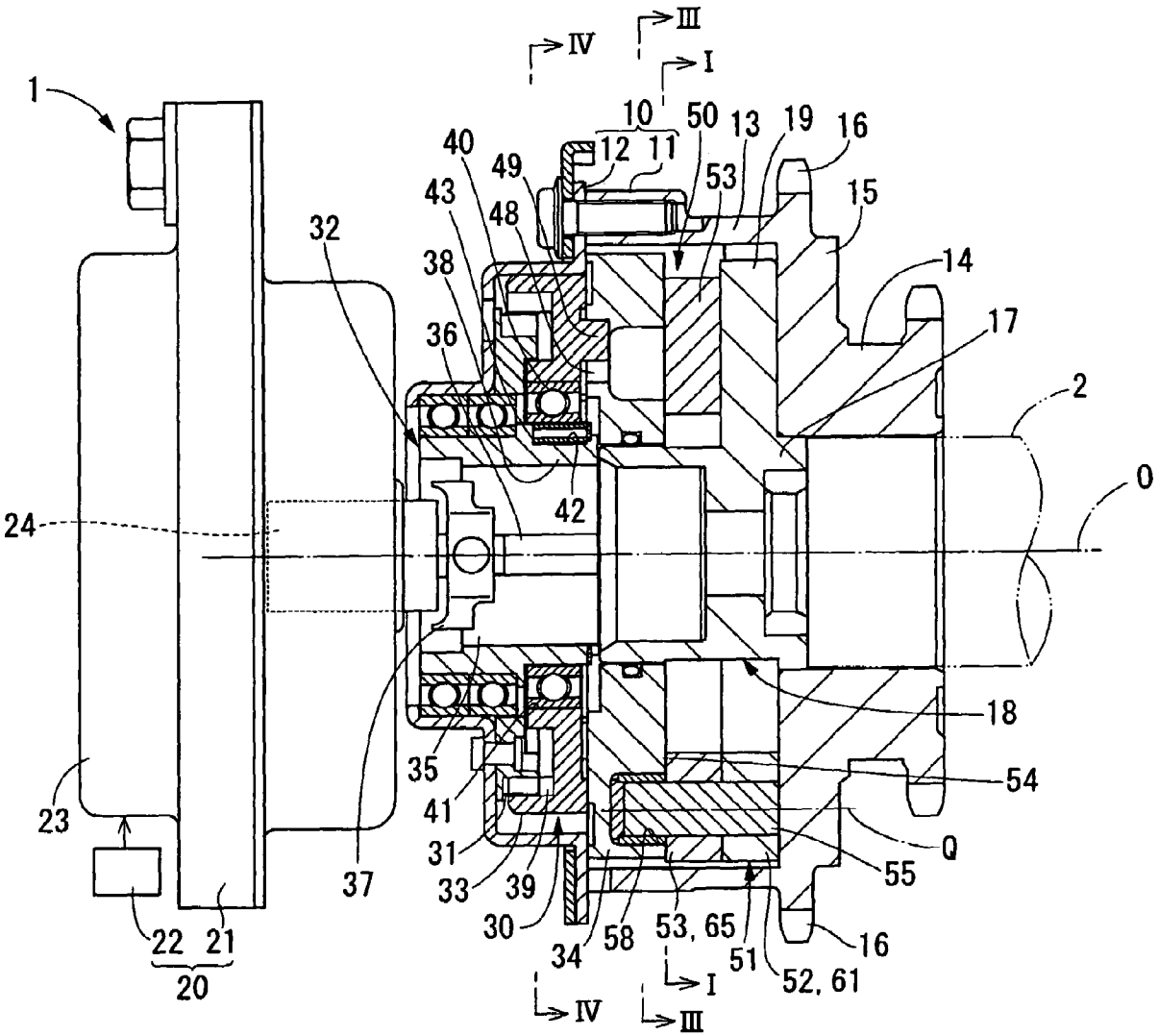
FIG. 2 is a cross-sectional view taken along a line II-II of FIG. 1.

FIG. 2 shows a valve timing controller 1 according to a first embodiment of the present invention. The valve timing controller 1 is provided in a transmission system which transmits engine torque from a crankshaft to a camshaft 2 for an internal combustion engine. The valve timing controller 1 changes a relative rotation phase between the crankshaft and the camshaft 2 to adjust valve timing of an intake valve.

The valve timing controller 1 includes a driving rotary element 10 (a first rotary element), a driven rotary element 18 (a second rotary element), a control unit 20, a differential gear mechanism 30, and a phase change mechanism 50.

Figure 1:
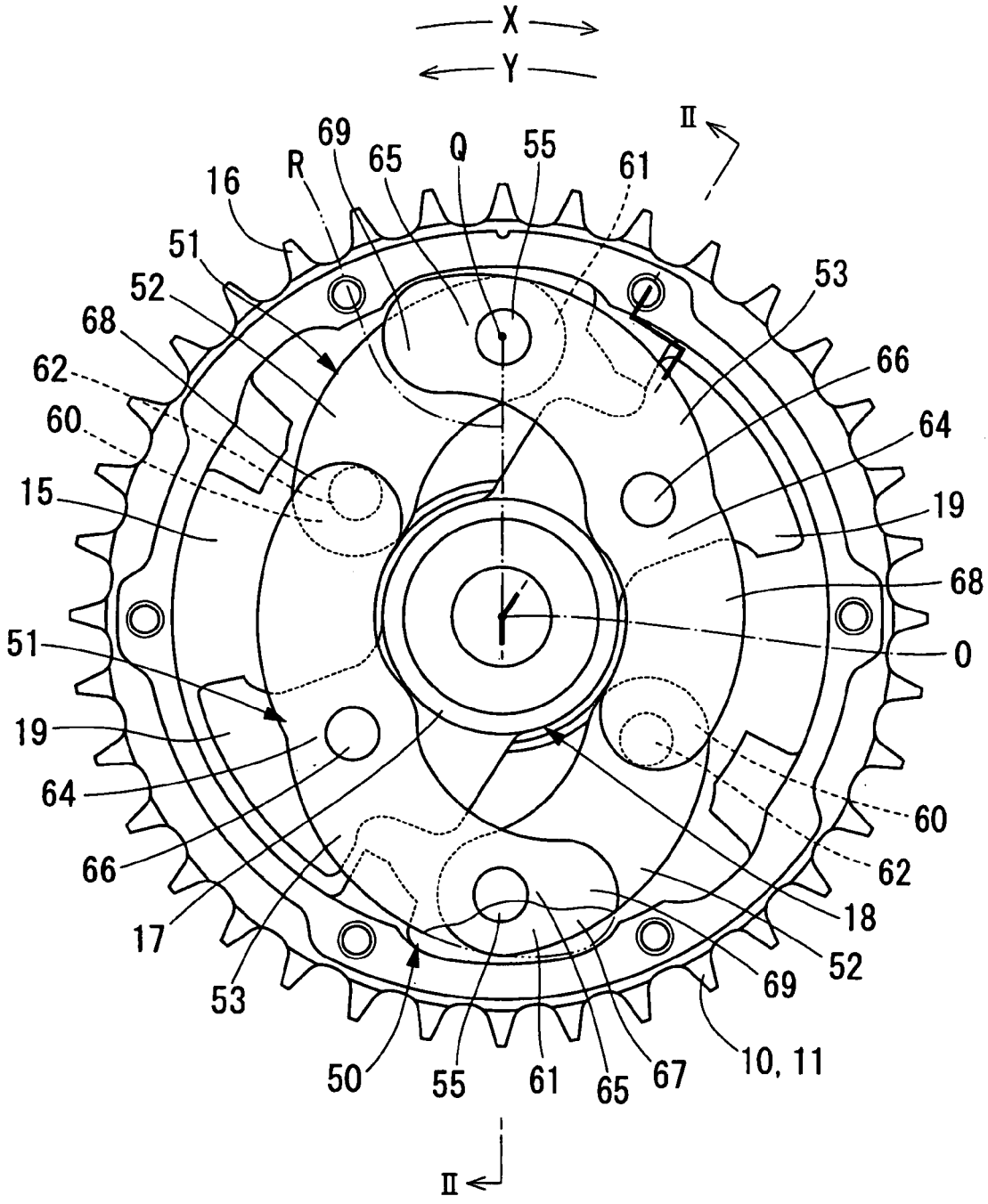
FIG. 1 is a cross-sectional view taken along a line I-I of FIG. 2 showing a valve timing controller according to a first embodiment of the present invention.
Figure 3:
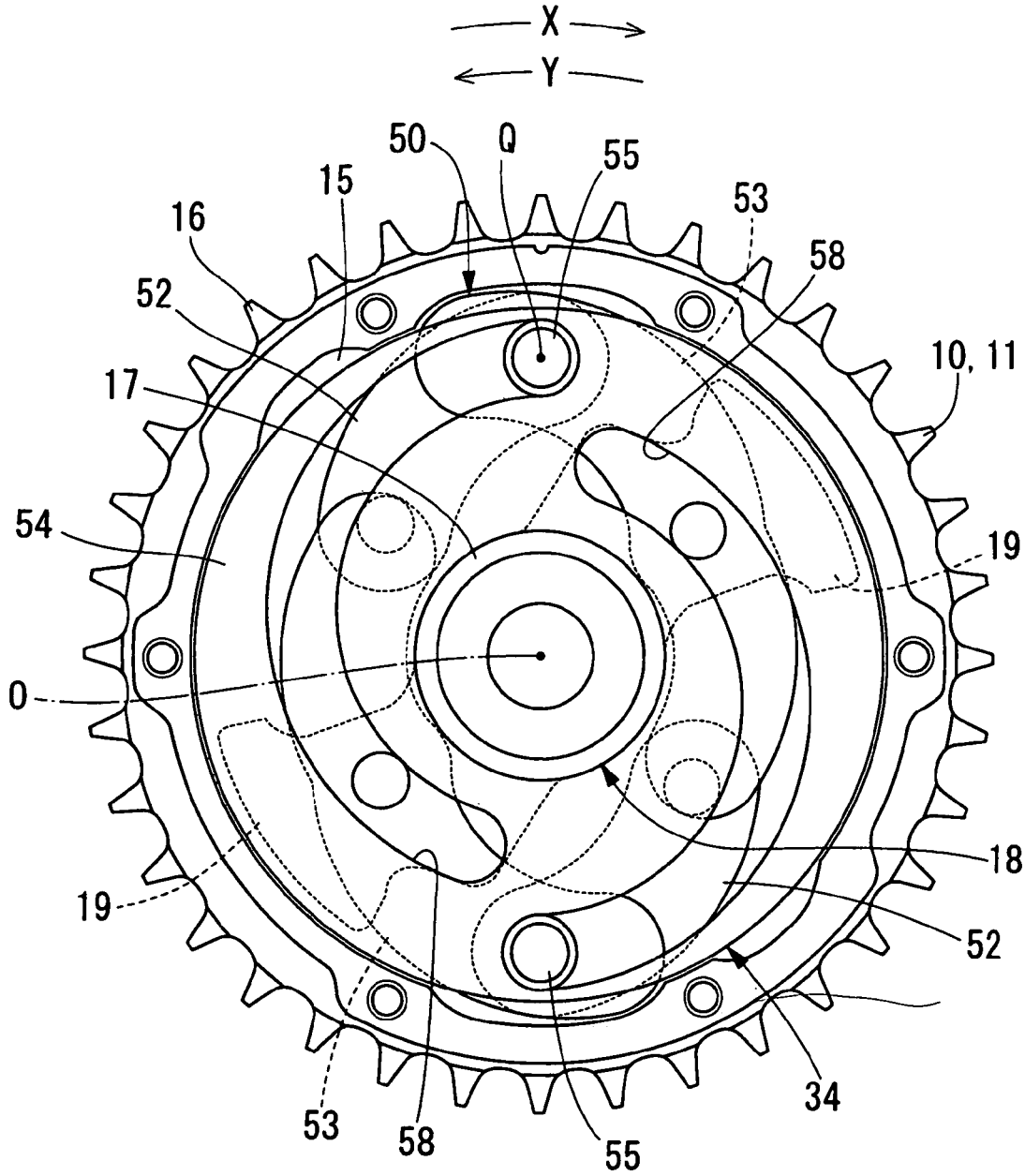
FIG. 3 is a cross-sectional view taken along a line III-III of FIG. 2.

As shown in FIGS. 1 to 3, the driving rotary element 10 is formed in a hollow shape as a whole and receives the differential gear mechanism 30, the phase change mechanism 50 and the like. The driving rotary element 10 includes a two-step cylindrical shaped sprocket 11 and a two-step cylindrical shaped cover 12. A larger diameter side end portion of the two-step cylindrical shaped sprocket 11 and a larger diameter side end portion of the two-step cylindrical shaped cover 12 are coaxially fixedly screwed. The sprocket 11 includes a larger diameter part 13, a smaller diameter part 14, a connection part 15 to connect between the larger diameter part 13 and the smaller diameter part 14 and a plurality of teeth 16 formed in the connection part. The teeth 16 are formed in a manner that the teeth project to an outer peripheral side thereof and a circular timing chain is wound between the teeth 16 and a plurality of teeth of the crankshaft. Thus, when engine torque outputted from the crankshaft is transmitted to the sprocket 11 through the timing chain, the driving rotary element 10 rotates around a rotational axis "O" in response to the movement of the crankshaft while maintaining a relative rotation phase with respect to the crankshaft. At the time, a rotational direction of the driving rotary element 10 is clockwise in FIGS. 1 and 3.

As shown in FIGS. 1 and 2, the driven rotary element 18 includes a shaft part 17 and a pair of linkage sections 19. The shaft part 17 is formed in a cylindrical shape and positioned coaxially with the driving rotary element 10 and the camshaft 2. An end portion of the shaft part 17 is slidably and rotatably fitted in the inner peripheral side of the connection part 15 of the sprocket 11 and also bolted to an end portion of the camshaft 2. Because of that, the driven rotary element 18 is rotatable around the rotational axis "O" in response to the movement of the camshaft 2, while maintaining a relative rotation phase with respect to the camshaft 2, and also, the driven rotary element 18 is relatively rotatable with respect to the driving rotary element 10.

A relative rotational direction in which the driven rotary element 18 rotates to an advanced side with respect to the driving rotary element 10 is referred to as a direction "X", and a relative rotational direction in which the driven rotary element 18 rotates to a retarded side with respect to the driving rotary element 10 is referred to as a direction "Y".

Each of the linkage sections 19 is formed in a flat plate shape to project radially outwardly from an intermediate part of the shaft part 17 and disposed respectively at a 180 degree rotation symmetrical position relative to the rotational axis "O".

As shown in FIG. 2, the control unit 20 is composed of an electric motor 21, an energization control circuit 22 and the like. The electric motor 21 is, for instance, a brushless motor or the like and includes a motor case 23 that is fixed to the internal combustion engine through a stay (not shown) and a motor shaft 24 that is supported rotatably in normal and reverse directions by the motor case 23. The energization control circuit 22 is an electrical circuit such as a microcomputer and is disposed outside or inside the motor case 23 to be electrically connected with the electric motor 21. The energization control circuit 22 controls energization to a coil (not shown) of the electric motor 21 in accordance with an operational state of the internal combustion engine or the like. With the energization control, the electric motor 21 forms a rotating magnetic field around the motor shaft 24 and generates rotational torque in the direction "X" or Y (refer to FIG. 4) corresponding to a direction of the rotating magnetic field to the motor shaft 24.

Figure 4:
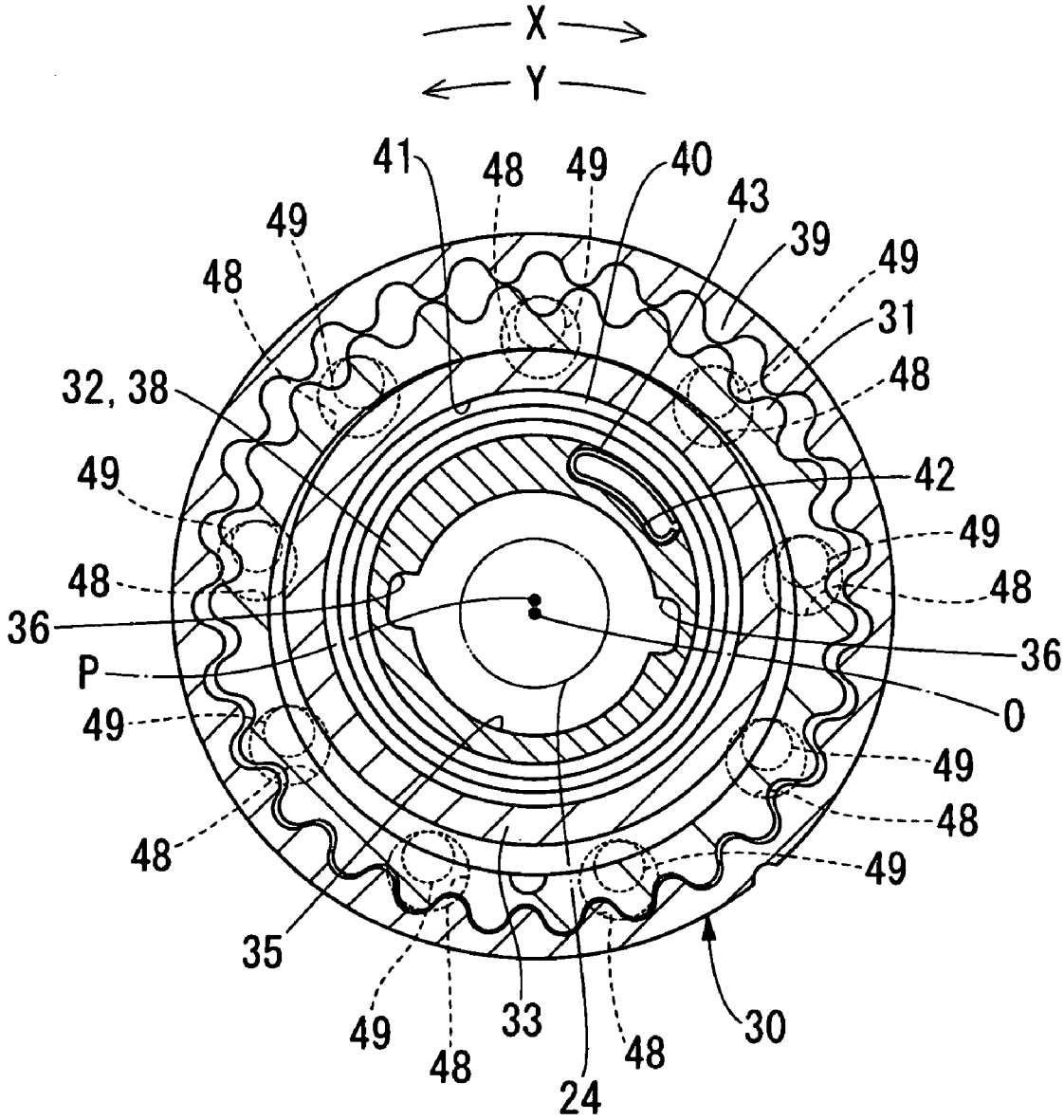
FIG. 4 is a cross-sectional view taken along a line of IV-IV of FIG. 2.

As shown in FIGS. 2 and 4, the differential gear mechanism 30 is formed of an external gear 31, a planetary carrier 32, an internal gear 33 and a guide rotary element 34.

The external gear 31 includes a tip circle and a root circle formed at the outer peripheral side of the tip circle and is riveted coaxially with the cover 12 to possibly rotate integrally with the driving rotary element 10.

The planetary carrier 32 is formed in a tubular shape as a whole and includes an inner peripheral surface 35 formed in a cylindrical surface shape coaxially with the driving rotary element 10. In the inner peripheral surface 35 of the planetary carrier 32, a groove 36 is opened, and by a joint 37 fitted into the groove 36, the motor shaft 24 is fixed to the planetary carrier 32 coaxially with the inner peripheral surface 35. With such fixation, the planetary carrier 32 can rotate around the rotational axis "O" in response to the movement of the motor shaft 24 and also can relatively rotate with respect to the driving rotary element 10. The planetary carrier 32 further includes an eccentric cam part 38 provided at the other side of the motor shaft 24, and the eccentric cam part 38 includes an outer peripheral surface of a cylindrical surface shape to be off-centered with respect to the driving rotary element 10.

The internal gear 33 is formed in a bottomed cylindrical shape and is provided with a gear part 39. The gear part 39 includes a tip circle and a root circle group at the inner peripheral side of the tip circle. The root circle of the gear part 39 is larger than the tip circle of the external gear 31. Moreover, the number of teeth of the gear part 39 is larger than the number of teeth of the external gear 31 by one. The gear part 39 is disposed at the outer peripheral side of the external gear 31, off-centered with respect to the rotational axis "O", and is meshed with the external gear 31 on the other side of the eccentric side.

A center hole 41 of the internal gear 33 has a cylindrical bore shape coaxially with the gear part 39 and is fitted into the outer peripheral side of the eccentric cam part 38 via a bearing 40. The internal gear 33 is supported by the planetary carrier 32 and can achieve a planetary motion to revolve in the rotational direction of the eccentric cam part 38, rotating around an eccentric centerline P of the outer peripheral surface of the eccentric cam part 38.

In the first embodiment, a receiving hole 42 opens into the outer peripheral surface of the eccentric cam part 38 and receives a U-shaped leaf spring 43 therein, and the leaf spring 43 presses an inner peripheral surface of the center hole 41 of the internal gear 33 via the bearing 40 and thus, the internal gear 33 is tightly meshed with the external gear 31.

As shown in FIGS. 2 and 3, the guide rotary element 34 is formed in an annular ring plate shape coaxially with the driving rotary element 10, and is slidably and rotatably fitted into an outer peripheral side of an end portion of the shaft part 17 of the driven rotary element 18 at the opposite side of the camshaft 2. Because of that, the guide rotary element 34 is rotatable around the rotational axis "O" and also relatively rotatable with respect to the rotary elements 10 and 18. As shown in FIGS. 2 and 4, the guide rotary element 34 includes cylindrical bore shaped engaging holes 48 which are formed at a plurality of spots (nine spots in the first embodiment) equally spaced in the rotational direction. In addition, corresponding to the above holes, the internal gear 3 includes columnar engaging projections 49 that are formed at a plurality of spots (nine spots in the first embodiment) equally spaced in the rotational direction of the internal gear 33. Each columnar engaging projection 49 projects into and engages with each corresponding engaging hole 48.

In the differential gear mechanism 30 with the configuration as described above, when the planetary carrier 32 does not relatively rotate with respect to the driving rotary element 10, the internal gear 33 rotates with the driving rotary element 10 without any planetary motion, and each engaging projection 49 presses each engaging hole 48 to the rotating side. As a result of that, the guide rotary element 34 rotates clockwise in FIG. 4, while maintaining a relative rotation phase between the guide rotary element 34 and the driving rotary element 10.

When the planetary carrier 32 relatively rotates in the direction "X" with respect to the driving rotary element 10 to move to an advanced side thereof owing to the increase of rotational torque in the direction "X" generated by the electric motor 21 or the like, the internal gear 33 performs a planetary motion while changing the meshing teeth between the internal gear 33 and the external gear 31, and therefore, the force with which each engaging projection 49 presses each engaging hole 48 to the rotating side is increased. As the result, the guide rotary element 34 relatively rotates in the direction "X" with respect to the driving rotary element 10 to move to the advanced side.

When the planetary carrier 32 relatively rotates in the direction "Y" with respect to the driving rotary element 10 to move to a retarded side thereof owing to the increase of rotational torque in the direction "Y" generated by the electric motor 21, an abnormal stop of the electric motor 21 during the operating of the internal combustion engine or the like, the internal gear 33 performs a planetary motion while changing the meshing teeth between the internal gear 33 and the external gear 31, and thereby, each engaging projection 49 presses each engaging hole 48 to the reverse rotating side. As a result of that, the guide rotary element 34 relatively rotates in the direction "Y" with respect to the driving rotary element 10 to move to the retarded side.

As described above, because of the relative rotational movement of the planetary carrier 32 with respect to the driving rotary element 10, the internal gear 33 performs a planetary motion and the planetary motion is transmitted to the guide rotary element 34. Thus, the guide rotary element 34 relatively rotates with respect to the driving rotary element 10.

Figure 5:
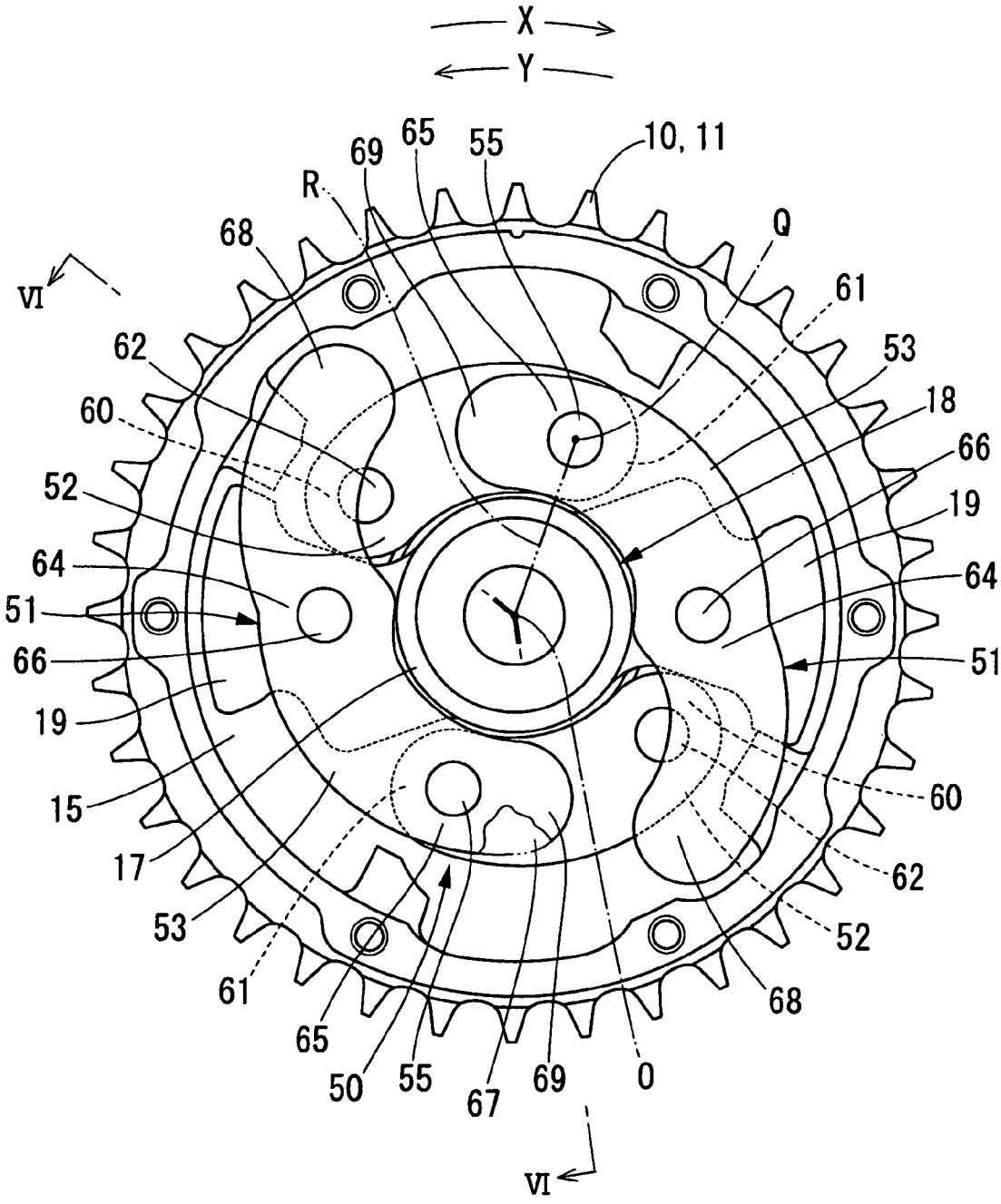
FIG. 5 is a cross-sectional view showing an operating condition different from that in FIG. 1.
Figure 6:
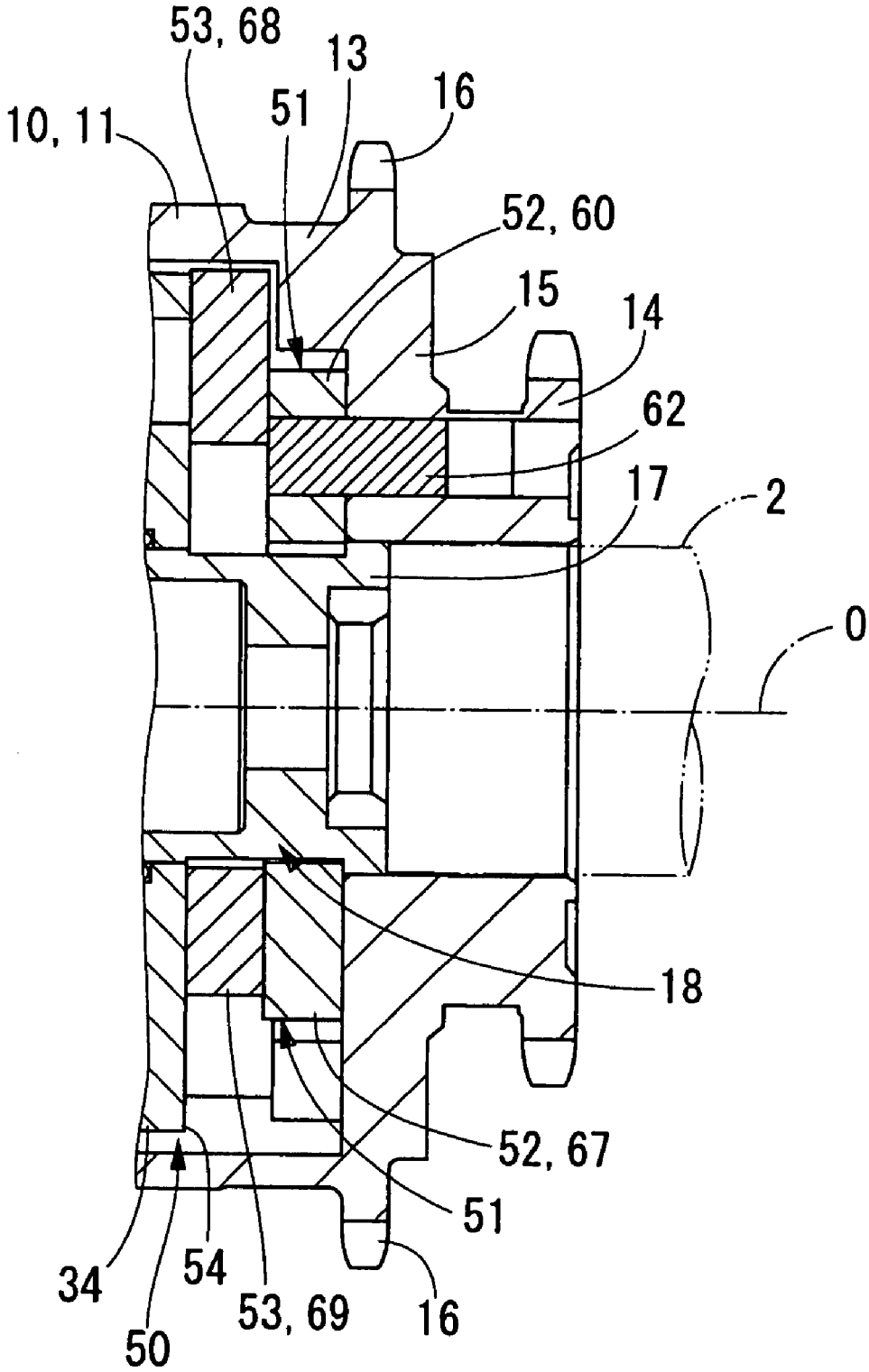
FIG. 6 is a cross-sectional view taken along a line of VI-VI of FIG. 5.

As shown in FIGS. 1 to 3 and FIGS. 5 and 6, the phase change mechanism 50 includes two groups of link mechanisms 51, a groove forming part 54 and a pair of movable shaft bodies 55. Each of FIGS. 1 to 3 shows a state of the phase change mechanism 50 when the driven rotary element 18 rotates to the most retarded side with respect to the driving rotary element 10, and each of FIGS. 5 and 6 shows a state of the phase change mechanism 50 when the driven rotary element 18 rotates to the most advanced side with respect to the driving rotary element 10. Further, in each of FIGS. 1, 3 and 5, hatching for showing a cross section is omitted.

As shown in FIGS. 1 and 2, each group of the link mechanisms 51 is composed of a combination of two kinds of links 52 and 53 and disposed respectively at a 180 degree rotation symmetrical position relative to the rotational axis "O".

The first link 52 of the link mechanism 51 in each group is formed in a flat plate shape to be extended in an arc shape and includes pairing elements 60 and 61 at both end portions thereof. As shown in FIGS. 5 and 6, a shaft 62 fixed to the connection part 15 is press-fitted to the pairing element 60. Thereby, the first link 52 is linked to the driving rotary element 10 by a revolute pair via the shaft 62. In addition, as shown in FIG. 1 and FIG. 2, a movable shaft 55 which is press-fitted and fixed to the second link 53 of the link mechanism 51 in the same group is relatively rotatably fitted in the pairing element 61. Thus, the first link 52 is linked to the second link 53 of the link mechanism 51 in the same group by a revolute pair via the movable shaft 55.

The second link 53 of the link mechanism 51 in each group is formed in a flat plate shape to be extended in w-shape and includes a first and a second pairing element 64, 65 in the intermediate part. As shown in FIG. 1, a shaft 66 which is press-fitted and fixed to the corresponding linkage section 19 is relatively rotatably fitted into the first pairing element 64. Thereby, the second link 53 is linked to the driven rotary element 18 by a revolute pair via the shaft 66. In addition, the movable shaft 55 for forming the revolute pair between the link 52 and the link 53 of the link mechanism 51 in the same group as mentioned above is press-fitted and fixed to the second pairing element 65.

As shown in FIGS. 1, 2, and 5, the second pairing element 65 in any operating state retains the pairing element 61 of the first link 52 of the link mechanism 51 in the same group between the second pairing element 65 and the connection part 15. The direction in which the second pairing element 65 retains the first link 52 of the link mechanism 51 in the same group between the second pairing element 65 and the connection part 15 is, as shown in FIG. 2, substantially equal to the rotational axis direction of the rotary elements 10, 19, 34 along the rotational axis "O".

As shown in FIGS. 1 and 5, in the link mechanism 51 of each group, the pairing element 60 of the first link 52 and the first pairing element 64 of the second link 53 are positioned at both sides of a radial line R in any operating state. Here, the radial line R means a virtual line connecting between a central line Q of the movable shaft 55 corresponding to the link mechanism 51 of each group and the rotational axis "O".

As shown in FIGS. 1 and 2, the second link 53 of the link mechanism 51 in each group includes at the both ends a first extending part 68 extending at the opposite side to the second pairing element 65 from the first pairing element 64 in the rotational direction of the rotary elements 10, 18, 34 and a second extending part 69 extending at the opposite side to the first pairing element 64 from the second pairing element 65 in the rotational direction thereof.

As shown in FIGS. 1, 5 and 6, in any operating state, the first extending part 68 retains the pairing element 60 of the first link 52 of the link mechanism 51 in the other group between the first extending part 68 and the connection part 15 and at the same time, contacts with the shaft 62 fitting into the pairing element 60 at the opposite side to the connection part 15.

In addition, in any operating state, the second extending part 69 retains a portion 67 in the first link 52 of the link mechanism 51 in the same group at the side of the pairing element 60 from the pairing element 61 between the second extending part 69 and the connection part 15. The direction in which each of the extending parts 68 and 69 retains the first link 52 of each of the link mechanisms 51 in the same group and in the other group between each of the extending parts 68 and 69 and the connection part 15 is, as shown in FIG. 6, substantially equal to the rotational axis direction of the rotary elements 10, 19, 34 along the rotational axis "O".

In addition, the second link 53 of the link mechanism 51 in each group contacts with the guide rotary element 34 (groove forming part 54 in the first embodiment) at the opposite side to the first link 52 of each of the link mechanisms 51 in the same group and in the other group, restricting the movement of the second link 53 toward the rotational axis direction of the rotary elements 10, 19, 34.

As shown in FIGS. 2 and 3, the groove forming part 54 is formed by a portion including a wall surface on the opposite side of the internal gear 33 in the guide rotary element 34. In the groove forming part 54, each of guide grooves 58 is formed at a 180 degree rotation symmetrical position relative to the rotational axis "O". Each guide groove 58 extends with a predetermined width at an outer peripheral side of the rotational axis "O" and has a curved shape to be inclined relative to a radial axis of the guide rotary element 34 such that the distance thereof from the rotational axis "O" changes in the extending direction.

Each guide groove 58 in the first embodiment is inclined in such a manner that the more each guide groove 58 moves in the direction "X", the further each guide groove 58 is separated from the rotational axis "O". Alternatively, the guide groove 58 may be inclined such that the more each guide groove 58 moves in the direction "Y", the further each guide groove 58 is separated from the rotational axis "O". In addition, each guide groove 58 may be formed in any other shapes such as a linear shape, besides the curbed shape as shown in FIG. 3.

As shown in FIGS. 1 to 3, each movable shaft 55 is formed into a cylindrical shaft to be off-centered relative to the rotational axis "O". One end portion of each movable shaft 55 is slidably fitted into each corresponding guide groove 58. The other end portion of each movable shaft 55 is relatively rotatably fitted into the pairing element 61 of the first link 52 constituting the corresponding group of the link mechanisms 51. The intermediate part of each movable shaft 55 is press fitted and fixed to the second pairing element 65 of the second link 53 constituting the corresponding group of the link mechanisms 51.

In the phase change mechanism 50 with the configuration as described above, when the guide rotary element 34 maintains the relative rotation phase between the guide rotary element 34 and the driving rotary element 10, each movable shaft 55 is not guided in the guide groove 58 but rotates with the guide rotary element 34. At this time, in each group of the link mechanisms 51, a relative positional relationship between the link 52 and the link 53 is not changed, and therefore, the driven rotary element 18 rotates clockwise in FIG. 3 while maintaining a relative rotation phase between the driven rotary element 18 and the driving rotary element 10. Thus, the relative rotation phase of the camshaft 2 with respect to the crankshaft, that is, the valve timing is maintained.

When the guide rotary element 34 relatively rotates in the direction "X" with respect to the driving rotary element 10 to move to the advanced side, each movable shaft 55 slides to the side where each movable shaft 55 approaches the rotational axis "O" in each guide groove 58. At this time, each movable shaft 55 rotationally drives the first link 52 of the corresponding group of the link mechanisms 51 with the shaft 62 serving as a fulcrum, and simultaneously is displaced to decrease distance between each movable shaft 55 and the rotational axis "O". As a result of that, the second link 53 of each group of the link mechanisms 51 is pressed by each movable shaft 55 to be driven with each linkage section 19 in the direction "X". Therefore, the driven rotary element 18 rotates to the advanced side with respect to the driving rotary element 10, and at the same time, the valve timing is advanced.

When the guide rotary element 34 relatively rotates in the direction "Y" with respect to the driving rotary element 10 to move to the retarded side, each movable shaft 55 slides to the side where each movable shaft 55 separates from the rotational axis "O" in each guide groove 58. At this time, each movable shaft 55 rotationally drives the first link 52 of the corresponding group of the link mechanisms 51 with the shaft 62 serving as a fulcrum, and simultaneously is displaced to increase distance between each movable shaft 55 and the rotational axis "O". As a result of that, the second link 53 of each group of the link mechanisms 51 is pulled by each movable shaft 55 to be driven with each linkage section 19 in the direction "Y". Therefore, the driven rotary element 18 rotates to the retarded side with respect to the driving rotary element 10, and at the same time, the valve timing is retarded.

As described above, each movable shaft 55 drives the links 52 and 53 of the link mechanisms 51 in each group while being displaced in accordance with the relative rotational movement of the guide rotary element 34 with respect to the driving rotary element 10. Thereby, the relative rotation phase between the rotary element 10 and the rotary element 18, that is, the valve timing is changed.

According to the first embodiment described above, the second link 53 of the link mechanism 51 in each group can retain the first link 52 of each of the link mechanisms 51 in the same group and the other group between the second link 53 and the connection part 15 regardless of an operating condition. This allows the area retained in the first link 52 of the link mechanism 51 in each group to be largely secured, so that it is restricted that the first link 52 of the link mechanism 51 in each group is inclined with respect to the rotational axis "O" by being shifted in the rotational axis direction of the rotary elements 10, 19, 34. Further, in the first embodiment, the link mechanisms 51 in the respective groups are arranged side by side at equal intervals in the rotational direction of the rotary elements 10, 19, 34, thereby controlling off-balance in rotation due to inclination of these rotational elements 10, 19, 34 with respect to the rotational axis.

According to such first embodiment, a smooth valve timing adjustment can be achieved by restricting the inclination of each of the rotary elements 10, 19, 34.

As described above, the first embodiment according to the present invention has been described, but the present invention is not intended to be limited to the embodiment and can also be applied to various sorts of embodiments in the scope of the preset invention without departing from the gist thereof.

For example, the link mechanisms described in the above embodiment may be formed of three or more groups thereof and theses link mechanisms may be arranged in the rotational direction of the rotary elements 10, 19, 34. In this case, the second link 53 of the link mechanism 51 in each group is designed to retain the first link 52 of the link mechanism 51 in the other group neighboring in the rotary elements 10, 19, 34 between the second link 53 and the rotary element 10.

In addition, contrary to the case of the first embodiment, the rotary element 10 may be rotated in response to the movement of the camshaft 2 and the rotary element 18 may be rotated in response to the movement of the crankshaft.

Figure 7:
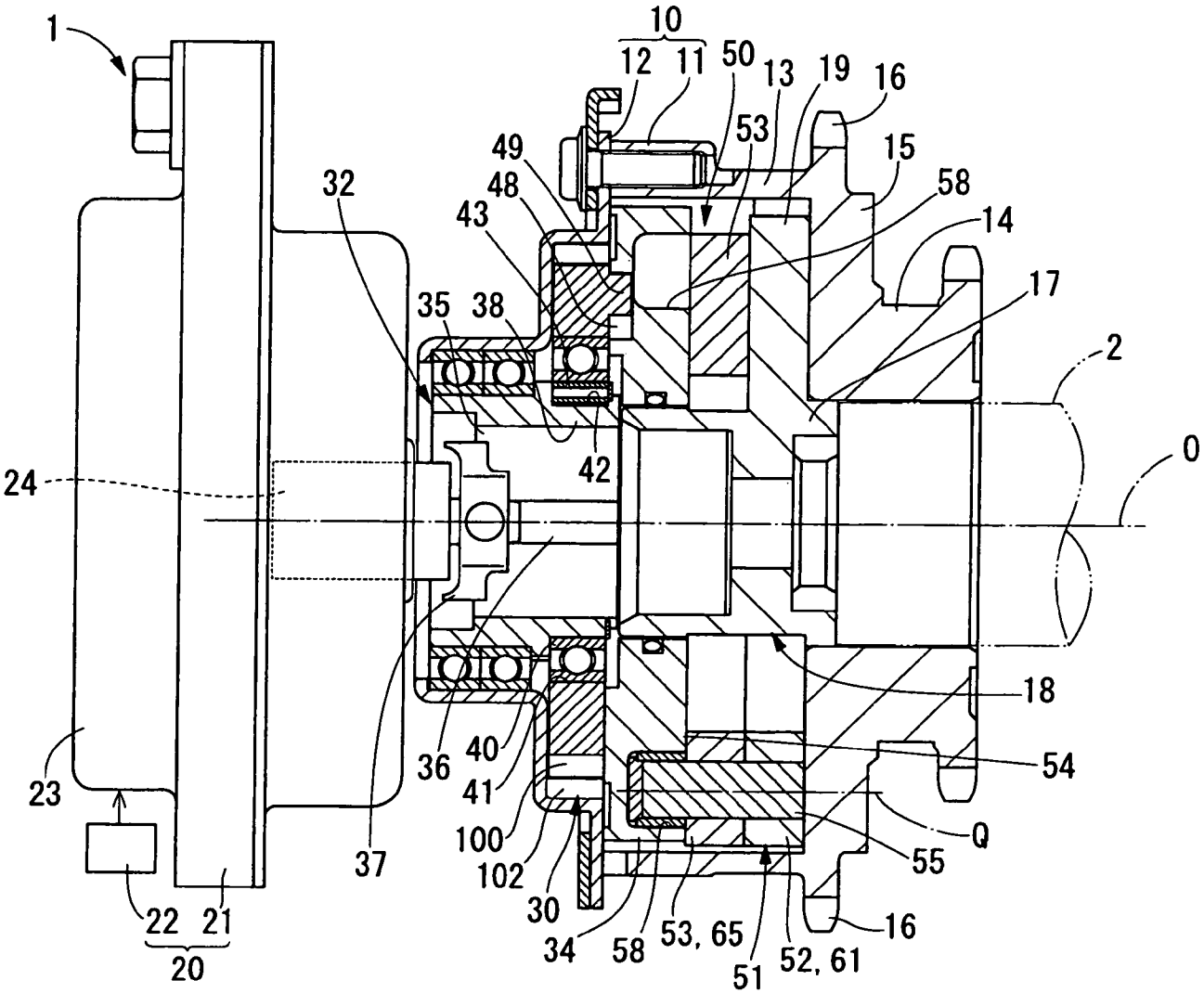
FIG. 7 is a cross-sectional view showing a modification of FIG. 2.

Additionally, as shown in FIG. 7, an external gear 100 including the engaging projection 49 and supported by the planetary carrier 32 may be provided instead of the internal gear 33 according to the first embodiment, and at the same time, an internal gear 102 to be meshed with the external gear 100 may be provided to the rotary element 10 instead of the external gear 31 according to the first embodiment.

Further additionally, instead of the electric motor 21 according to the first embodiment, an electromagnetic brake device, a hydraulic motor or the like which includes a brake member rotating by the transmission of crankshaft driving torque and a solenoid magnetically attracting the brake member and produces braking torque generated in the brake member magnetically attracted by the solenoid as rotational torque may be used.

Still furthermore, the invention may be applied to a device to adjust the valve timing of an exhaust valve or a device to adjust the valve timing of both the intake valve and the exhaust valve, besides the device to adjust the valve timing of the intake valve as in the first embodiment.

What is claimed is:

1. A valve timing controller for an internal combustion engine that adjusts opening/closing timing of at least one of an intake valve and an exhaust valve opened/closed by a camshaft with torque transmission from a crankshaft, comprising:

a first rotary element rotating in response to the movement of one of the crankshaft and the camshaft;

a second rotary element including a common rotational axis with the first rotary element, and rotating in response to the movement of the other of the crankshaft and the camshaft; and a plurality of link mechanisms arranged adjacently in a rotational direction of the first rotary element to change a relative rotation phase between the first rotary element and the second rotary element, wherein:

the link mechanism in each group is constituted by combining a first link linked to the first rotary element by a revolute pair with a second link linked to the second rotary element and the first link by a revolute pair; and the second link of the link mechanism in each group retains the first link of the link mechanism in the same group and the first link of the link mechanism in the other group between the second link and the first rotary element in the rotational axis direction of the first rotary element.

2. A valve timing controller according to claim 1, wherein:

the second link of the link mechanism in each group includes a first pairing element constituting a revolute pair with the second rotary element, a second pairing element constituting a revolute pair with the first link of the link mechanism in the same group, and an extending part extending in the opposite side to the second pairing element from the first pairing element in the rotational direction, and the extending part retains the first link of the link mechanism in the other group between the extending part and the first rotary element.

3. A valve timing controller according to claim 2, wherein:

the second link of the link mechanism in each group includes a first extending portion and a second extending portion extending in the opposite side to the first pairing element from the second pairing element in the rotational direction, and the second extending portion retains the first link of the link mechanism in the same group between the second extending portion and the first rotary element.

4. A valve timing controller according to claim 1, wherein:

the first link of the link mechanism in each group is linked to the first rotary element by a revolute pair via a shaft; and the second link of the link mechanism in each group contacts with the shaft at the opposite side to the first rotary element, wherein the shaft is fitted so as to relatively rotate into the first link of the link mechanism in the other group retained between the second link and the first rotary element in the rotational axis direction.

5. A valve timing controller according to claim 1, further comprising a driving means which drives the link mechanism in each group by using rotational torque generated by an electric motor.

* * * * *